US009324533B2

(12) United States Patent
Horne

(10) Patent No.: US 9,324,533 B2
(45) Date of Patent: Apr. 26, 2016

(54) MEDIUM VOLTAGE CONTROLLABLE FUSE

(71) Applicant: MERSEN USA NEWBURYPORT—MA, LLC, Newburyport, MA (US)

(72) Inventor: Kevin M. Horne, Gloucester, MA (US)

(73) Assignee: MERSEN USA NEWBURYPORT-MA, LLC, Newburyport, MA (US)

( * ) Notice: Subject to any disclaimer, the term of this patent is extended or adjusted under 35 U.S.C. 154(b) by 490 days.

(21) Appl. No.: 13/804,384

(22) Filed: Mar. 14, 2013

(65) Prior Publication Data

US 2014/0266561 A1 Sep. 18, 2014

(51) Int. Cl.

| | |
|---|---|
| ***H01H 89/00*** | (2006.01) |
| ***H01H 85/44*** | (2006.01) |
| *H01H 39/00* | (2006.01) |
| *H01H 85/36* | (2006.01) |
| *H01H 37/76* | (2006.01) |
| *H01H 85/46* | (2006.01) |

(52) U.S. Cl.

CPC ..... *H01H 85/44* (2013.01); *H01H 39/006* (2013.01); *H01H 85/36* (2013.01); *H01H 2037/762* (2013.01); *H01H 2085/466* (2013.01)

(58) Field of Classification Search

CPC ..... H01H 39/006; H01H 85/25; H01H 85/44; H01H 85/46; H01H 2037/762; H01H 2085/466; H01H 85/36

USPC ..... 337/12, 190, 238, 261

See application file for complete search history.

(56) References Cited

U.S. PATENT DOCUMENTS

| | | | | |
|---|---|---|---|---|
| 3,259,719 A | 7/1966 | Innis et al. | ..... | 200/120 |
| 3,304,390 A | 2/1967 | Lindell | ..... | 200/120 |
| 3,648,210 A * | 3/1972 | Kozacka | ..... | H01H 85/10 337/161 |
| 4,198,615 A * | 4/1980 | Mahieu | ..... | H01H 85/46 337/162 |
| 4,344,058 A * | 8/1982 | Knapp, Jr. | ..... | H01H 85/0052 337/148 |
| 4,383,236 A * | 5/1983 | Urani | ..... | H01H 37/761 337/142 |

(Continued)

FOREIGN PATENT DOCUMENTS

| | | | | |
|---|---|---|---|---|
| FR | 2694986 A1 * | 2/1994 | ..... | H01H 33/06 |
| GB | 385478 A * | 12/1932 | ..... | H01H 33/06 |

(Continued)

OTHER PUBLICATIONS

Wachter, FR 2694986 A1, Machine Translation.*

(Continued)

*Primary Examiner* — Anatoly Vortman
*Assistant Examiner* — Jacob Crum
(74) *Attorney, Agent, or Firm* — Kusner & Jaffe

(57) ABSTRACT

An electric fuse, having a first fusible element and a disconnect section electrically connected in series to the first fusible element. The disconnect section is comprised of a first stationary contact, a second stationary contact and a movable contact movable from a first position electrically connecting the first and second stationary contacts to form a conductive path through the disconnect section to a second position electrically separating the first and second stationary contacts from each other and terminating the conductive path through the disconnect section. A retaining element holds the movable contact in the first position, the retaining element operable to release the movable contact from the first position when activated by an electrical (actuation) signal from an external source.

15 Claims, 8 Drawing Sheets

(56) References Cited

U.S. PATENT DOCUMENTS

| | | | | | |
|---|---|---|---|---|---|
| 4,427,963 | A * | 1/1984 | Jarosz | H01H 39/006 | 337/241 |
| 4,559,513 | A * | 12/1985 | Gaia | H01H 85/36 | 337/163 |
| 4,593,262 | A | 6/1986 | Krueger | 337/163 | |
| 4,617,544 | A | 10/1986 | Mooz et al. | 337/3 | |
| 4,952,900 | A | 8/1990 | Cameron et al. | 337/217 | |
| 5,043,689 | A * | 8/1991 | Di Troia | H01H 85/055 | 337/163 |
| 5,084,691 | A | 1/1992 | Lester et al. | 337/297 | |
| 5,406,438 | A * | 4/1995 | Ranjan | H02H 3/021 | 361/103 |
| 5,485,136 | A | 1/1996 | Johnson et al. | 337/168 | |
| 5,892,427 | A * | 4/1999 | Handcock | H01H 85/042 | 337/160 |
| 6,141,202 | A * | 10/2000 | Maeckel | H01H 85/46 | 337/143 |
| 6,256,183 | B1 | 7/2001 | Mosesian | 361/104 | |
| 2002/0109574 | A1 * | 8/2002 | Handcock | H01H 85/055 | 337/292 |
| 2008/0117015 | A1 | 5/2008 | Leach | 337/238 | |
| 2012/0299692 | A1 | 11/2012 | Whitney et al. | 337/297 | |

FOREIGN PATENT DOCUMENTS

| | | | | |
|---|---|---|---|---|
| JP | 2011-113907 | A | 6/2011 | H01H 37/76 |
| KR | 10-2006-0053324 | A | 5/2006 | H01H 85/04 |

OTHER PUBLICATIONS

International Search Report and Written Opinion received in corresponding PCT Application No. PCT/US2014/015929, dated May 26, 2014.

* cited by examiner

MEDIUM VOLTAGE CONTROLLABLE FUSE

FIELD OF THE INVENTION

The present invention relates generally to the field of electrical protection devices, more particularly to an electric current interruption device, and even more particularly to a medium voltage current-limiting fuse.

BACKGROUND OF THE INVENTION

Medium voltage (MV) current-limiting fuses are widely used in the electrical utility and switchgear manufacturing industries for voltages typically in the range of 1 kV to 72.5 kV. The main function of such fuses is to protect electrical apparatus (e.g., distribution transformers, motors, and capacitor banks) against over currents. In some fuse applications, it is desirable to trigger (i.e., open) the fuse when an event external to the fuse occurs.

The present invention provides a medium voltage electric fuse that is operable to open if subjected to excessive short circuit conditions and that can be caused to open in response to an electrical signal that is triggered by an external event.

SUMMARY OF THE INVENTION

In accordance with a preferred embodiment of the present invention, there is provided an electric fuse, comprised of a tubular casing formed of an electric insulating material. A first conductive ferrule is attached to a first end of the casing the first conductive ferrule having an opening therethrough. A second conductive ferrule is attached to a second end of the casing. A first fusible element within the casing is electrically connected to the second conductive ferrule. A disconnect section is electrically connected in series to the first fusible element and the first conductive ferrule. The disconnect section is comprised of a first stationary contact electrically connected to the first conductive ferrule and a second stationary contact electrically connected to the first fusible element. A movable contact is movable from a first position electrically connecting the first and second stationary contacts to form a conductive path through the disconnect section to a second position electrically separating the first and second stationary contacts from each other and terminating the conductive path through the disconnect section. The movable contact is biased toward the second position. A retaining element holds the movable contact in the first position. The retaining element is operable to release the movable contact from the first position when activated by an electrical (actuation) signal from an external source.

In accordance with another aspect of the present invention, there is provided an electric fuse, comprised of a tubular casing formed of an electric insulating material. A first conductive ferrule is attached to a first end of the casing, the first conductive ferrule having an opening therethrough. A second conductive ferrule is attached to a second end of the casing. A first conductive path is defined between the first ferrule and the second ferrule. The first conductive path is comprised of a disconnect section in series with a first fusible element having a first current carrying capacity. The disconnect section is comprised of spaced-apart contact elements, a movable contact element, and a retaining element maintaining the movable contact in electrical contact with the spaced-apart contacts. A biasing element biases the movable contact element to a second position destroying the first conductive path. A second conductive path defined between the first ferrule and the second ferrule. The second conductive path is comprised of a second fusible element in series with the first fusible element. The second fusible element has a second current carrying capacity less than the first current carrying capacity.

An advantage of the present invention is the provision of a MV current-limiting fuse that responds rapidly to interrupt the electrical current in the event of high current faults.

Another advantage of the present invention is an electric fuse that operates as a conventional fuse when subject to excessive short circuit conditions, and can also be caused to open by an electrical signal applied to the fuse by an external source.

Another advantage of the present invention is the provision of a controllable MV current-limiting fuse.

Another advantage of the present invention is the provision of a MV current-limiting, controllable fuse as described above, that responds rapidly to interrupt the electrical current in response to an external condition, such as, by way of example and not limitation, an arc flash, overvoltage, light level, temperature, pressure, or the like.

Another advantage of the present invention is to provide a time delay fuse as described above that is operable to actuate an external device such as an electrical switch.

Another advantage of the present invention is to provide a time delay fuse as described above having a fusible element that is not influenced by a biasing device.

Another advantage of the present invention is MV fuse as described above that contains an arc-quenching material that does not interfere with a mechanical disconnect section.

Still another advantage of the present invention is the provision of a MV current-limiting controllable fuse that is responsive to an external condition, such as an arc flash, an overvoltage condition, a temperature level, a pressure level, etc.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
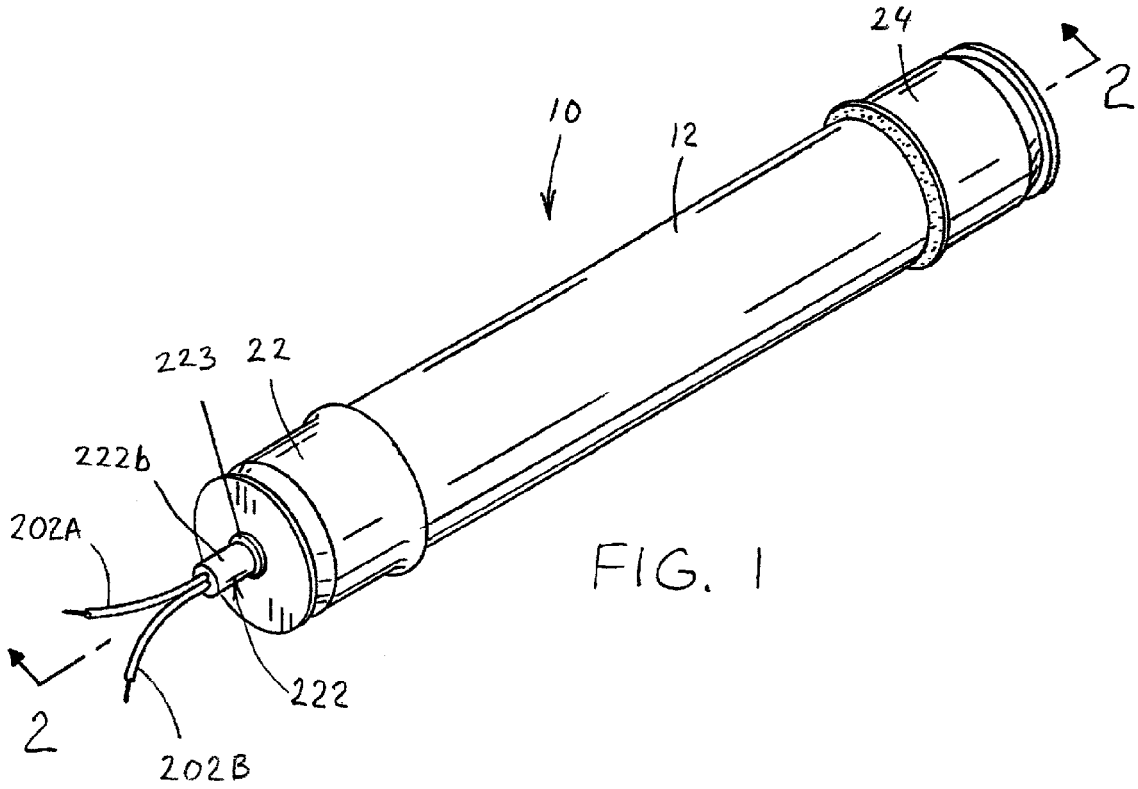
FIG. 1 is a perspective view of a medium voltage (MV) fuse illustrating a preferred embodiment of the present invention.

Referring now to the drawings wherein the showings are for the purpose of illustrating preferred embodiments of the invention only, and not for the purpose of limiting same, FIG. 1 shows a controllable, medium voltage (MV) fuse 10 illustrating a preferred embodiment of the preferred invention. Fuse 10 is generally comprised of a tubular, insulative fuse casing 12 having an inner bore or cavity 14 that extends axially through fuse casing 12. In the embodiment shown, fuse casing 12 is a cylindrical shape and defines a cylindrical cavity 14.

A first end ferrule 22 is provided for attachment onto one end of fuse casing 12 and a second end ferrule 24 is provided for attachment onto the other end of fuse casing 12. First end ferrule 22 includes an opening 26 therethrough that communicates with cavity 14. Ferrules 22, 24 are formed from an electrically conductive metal such as bronze, copper or alloys thereof.

Attached to ferrule 22 is a connector 32, and attached to ferrule 24 is a connector 34. Connectors 32, 34 are preferably identical. Therefore, only ferrule 32 will be described in detail, it being understood that such description also applies to ferrule 34. Connector 32, best seen in FIG. 7, is generally cup-shaped, and has a flat, circular bottom wall 36 and a cylindrical side wall 38 extending to one side thereof. A plurality of spaced-apart tabs 42 extends outwardly and away from the free edge of side wall 38. As shown in the drawings, connectors 32, 34 are disposed within cavity 14 of fuse casing 12 near each end of fuse casing 12. Connector 32 is dimensioned such that tabs 42 are in contact (or near contact) with the inner surface of ferrule 22. Tabs 42 are attached to the inner surface of ferrule 22 to be in electrical contact therewith. Preferably, tabs 42 are welded or soldered to the inner surfaces of ferrule 22. In similar fashion, connector 34 is attached to ferrule 24. A hole 44 (best seen in FIGS. 4, 5 and 6) is formed in the center of bottom wall 36 of connector 32. In the embodiment shown, hole 44 is circular. A plurality of access opening 46 surrounds the centrally located hole 44. Connectors 32, 34 are formed of a conductive material, such as, by way of example and not limitation, brass or copper.

Contained within cavity 14 of fuse casing 12 is a fuse assembly 50. Fuse assembly 50 is comprised of a disconnect section 60 and a high-current fuse section 260.

Disconnect section 60 is basically comprised of two, spaced-apart stationary contacts 70, 80 and a movable contact 150. First stationary contact 70 (best seen in FIG. 6) is essentially a cylindrical block having planar end surfaces 70*a*, 70*b*. End surface 70*a* is dimensioned to abut one side of bottom wall 36 of connector 32 at the first end of fuse casing 12, so as to be in electrical communication herewith. A centrally-located opening 72 extends through first stationary contact 70. In the embodiment shown, opening 72 is cylindrical in shape.

Second stationary contact 80 is also a cylindrical block having an opening 82 formed therethrough. A cylindrical wall 84 extends from one side of second stationary contact 80. Wall 84 and opening 82 are symmetrical about an axis through second stationary contact 80. Spaced-apart slots are formed in wall 84. The slots are aligned along lines radiating from the central axis of opening 82 through second stationary contact 80.

Second stationary contact 80 is spaced from first stationary contact 70 by a tubular insulator 92. Insulator 92 is a cylindrical tube having a first end that is dimensioned to be connected onto first stationary contact 70. A second end of insulator 92 is dimensioned to receive second stationary contact 80. In this respect, first and second stationary contacts 70, 80 are spaced apart from each other and are positioned to be symmetrical about the axis of insulator 92. Fastener elements 94, in the form of plastic pins, having heads 96 secure tubular insulator 92 to first and second stationary contacts 70, 80. In the embodiment shown, insulator 92 is formed from a glass-melamine material.

First and second contact members 70, 80 are dimensioned such that, when mounted to insulator 92, opening 82 in second stationary contact 80 is co-axially aligned with cylindrical opening 72 formed in first stationary contact 70. As illustrated in the drawings, first and second stationary contacts 70, 80, together with tubular insulator 92, define an enclosed chamber 98.

As indicated above, end surface 70*a* of first stationary contact 70 abuts one side of bottom wall 36 of connector 32. As best seen in FIG. 6, opening 72 in first stationary contact 70 is in registry with central hole 44 in bottom wall 36 of connector 32.

An insulating block 112 is dimensioned to be positioned against bottom wall 36 of connector 32 on the opposite side to first stationary contact 70. In the embodiment shown, insulating block 112 is cylindrical in shape, and has a cylindrical bore 114 extending into one side thereof. Bore 114 is coaxially aligned with openings 72, 82 in first and second stationary contacts 70, 80. Bore 114 is dimensioned to correspond in diameter to opening 72 in first stationary contact 70.

A tubular insert 122 (best seen in FIG. 6) is disposed in opening 72 in first stationary contact 70. Insert 122 is dimensioned to extend through opening 72 in first stationary contact 70 and partially into bore 114 of insulating block 112. Insert 122 is cylindrical in shape, and includes inwardly extending flexible fingers or tangs 124. Insert 122 is formed of a conductive material, such as copper or brass or alloys thereof. Insert 122 is preferably dimensioned to be pressed fit into first stationary contact 70 and insulating block 112.

A like insert 122 with fingers 124 is disposed in opening 82 of second stationary contact 80. As will be appreciated, because openings 72, 82 in first and second stationary contacts 70, 80 are coaxially aligned, openings through inserts 122 are also coaxially aligned.

Figure 9:
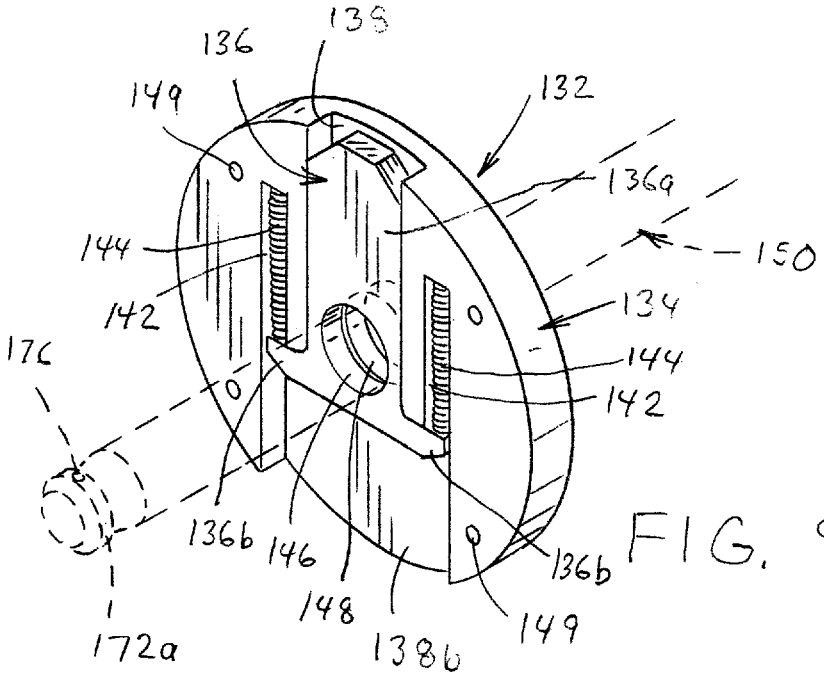
FIG. 9 is a perspective view of a shutter assembly showing a movable shutter in a first operating position.
Figure 10:
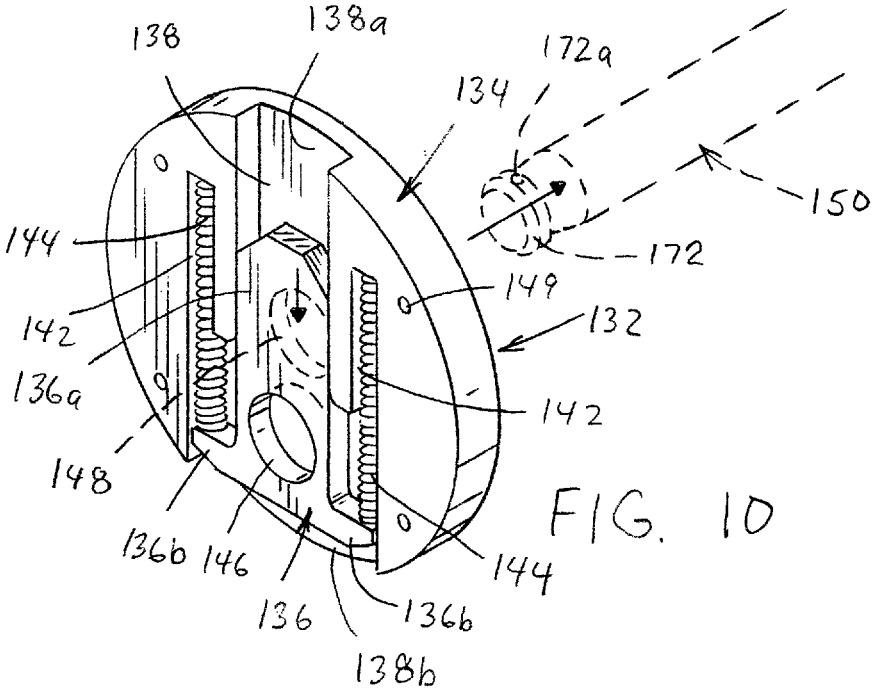
FIG. 10 is a perspective view of the shutter assembly shown in FIG. 9, showing the shutter in a second operating position.

A shutter assembly 132, best seen in FIGS. 9 and 10, is disposed within tubular insulator 92. Shutter assembly 132 is attached to first stationary contact 70. Shutter assembly 132 is comprised of a frame 134 and a movable shutter 136. Frame 134 is essentially a circular disk having a slot 138 formed along one face thereof. Slot 138 has a narrow section 138*b* extending over a portion of the surface of frame 134. When viewed from above, slot 138 is generally T-shaped. Two spaced-apart channels 142 extend from the edges of wider section 138*b* adjacent to and spaced from narrow section 138*a*. Channels 142 are dimensioned to receive biasing elements 144 in the form of helical springs, as shall be described in greater detail below.

Shutter 136 is a plate-like member having a generally rectangular body 136*a* with outward extending arms 136*b* formed at one end thereof. Rectangular body 136*a* of shutter 136 is dimensioned to be disposed within narrow section 138*a* of slot 138 in frame 134. Arms 136*b* of shutter 136 are dimensioned to be received within wider portion 138*b* of slot 138 in frame 134. Shutter 136 includes an opening 146 near one end thereof. In the embodiment shown, opening 146 is circular and is disposed near the end of shutter 136 where arms 136*b* extend therefrom. Opening 146 is dimensioned to allow movable contact 150 to pass therethrough. Frame 134 has a similar opening 148 centrally located therein.

Frame 134 includes a plurality of mounting holes 149 dimensioned to receive conventional fasteners (not shown) that extend through frame 134 into first stationary contact 70. Frame 134 is mounted to first stationary contact 70 with shutter 136 disposed therebetween. When shutter 136 is disposed within slot 138 of frame 134, biasing elements 144, i.e., the compression springs within parallel channels 142 act against outward extending arms 136*b* of shutter 136 to bias shutter 136 to one edge of frame 134. Shutter 136 is movable against biasing elements 144 to a position where opening 146 in shutter 136 aligns with opening 148 in frame 134, as shown in FIG. 9.

Figure 4:
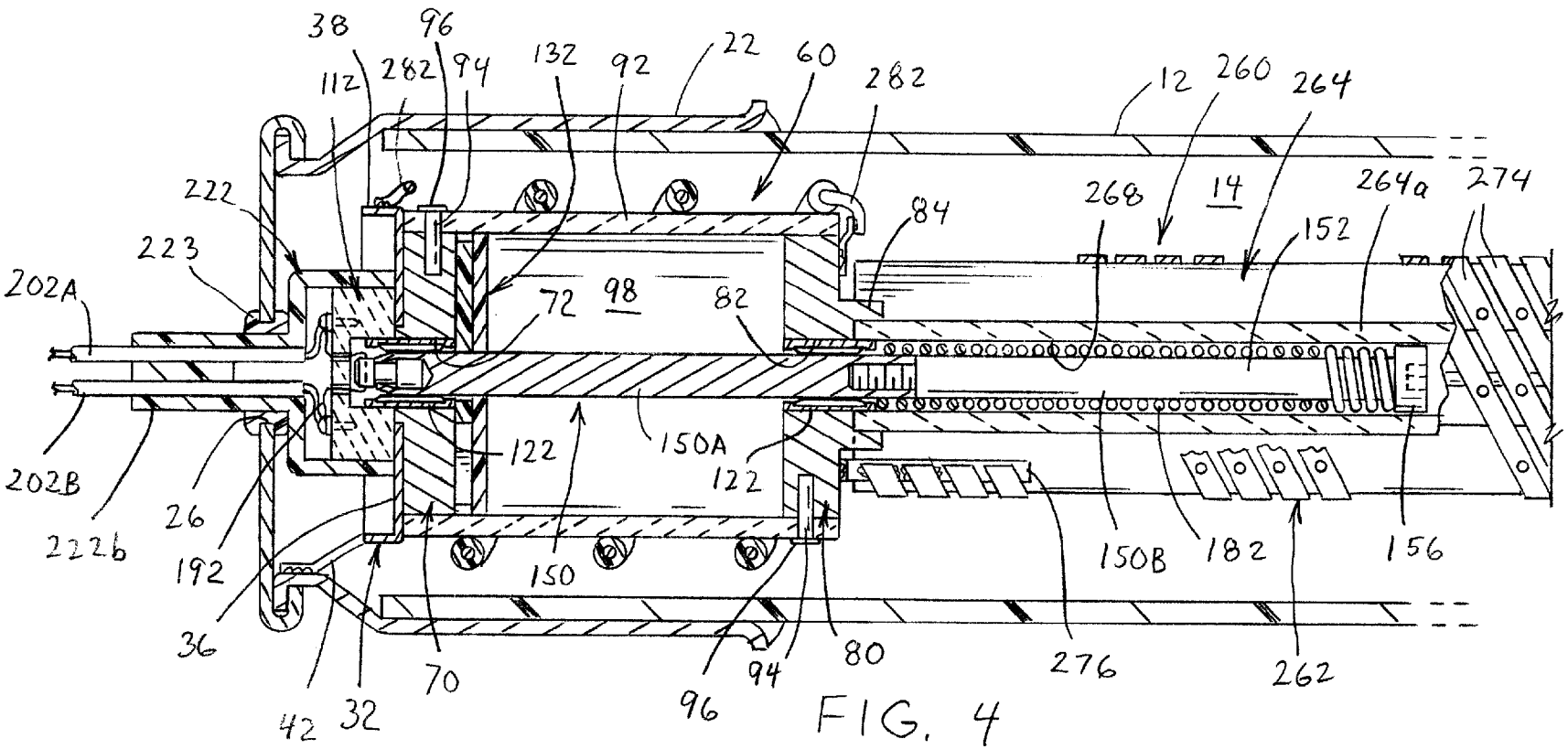
FIG. 4 is an enlarged sectional view of a first end of the MV fuse showing a fuse disconnect section in a fuse connect position.
Figure 5:
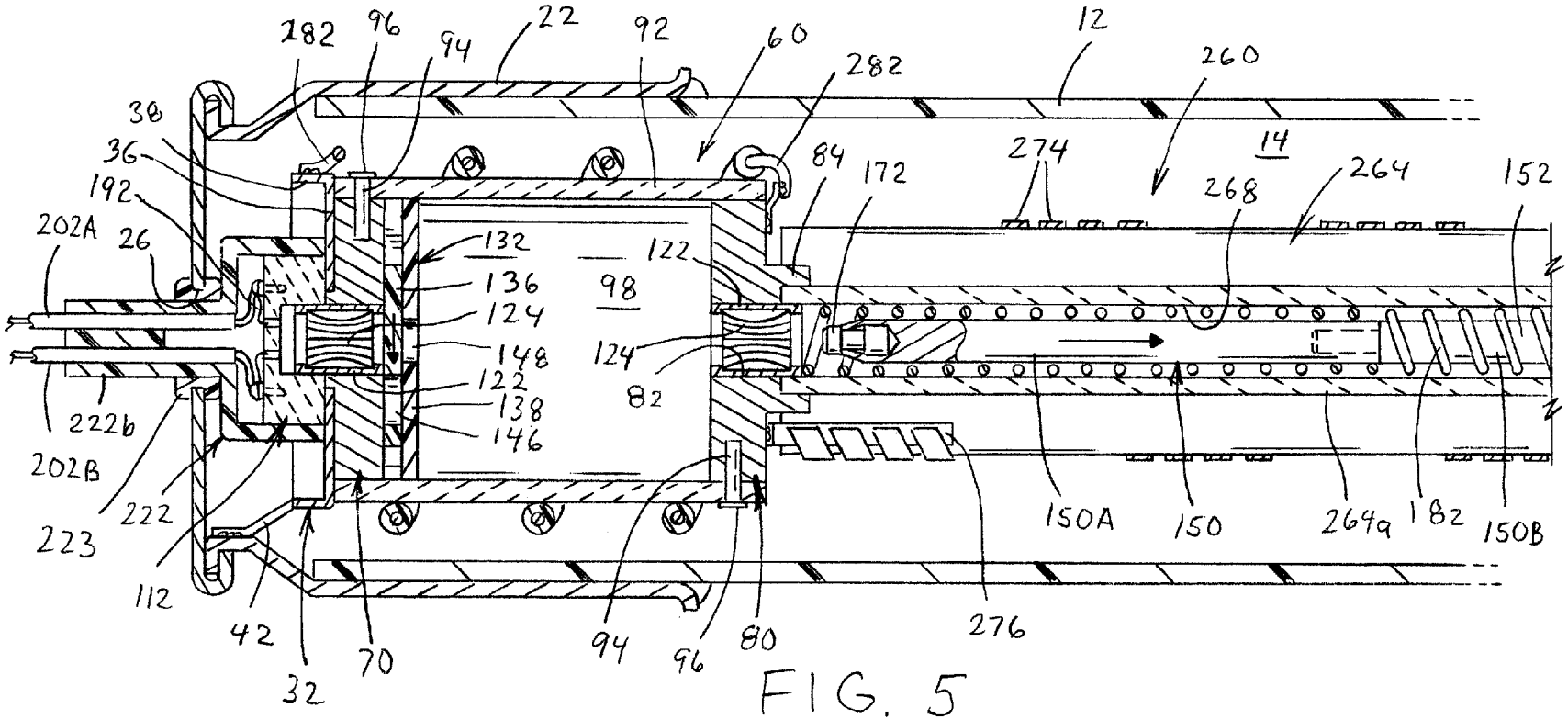
FIG. 5 is an enlarged cross-sectional view of the first end of the fuse showing the fuse disconnect section in a fuse disconnect position.
Figure 6:
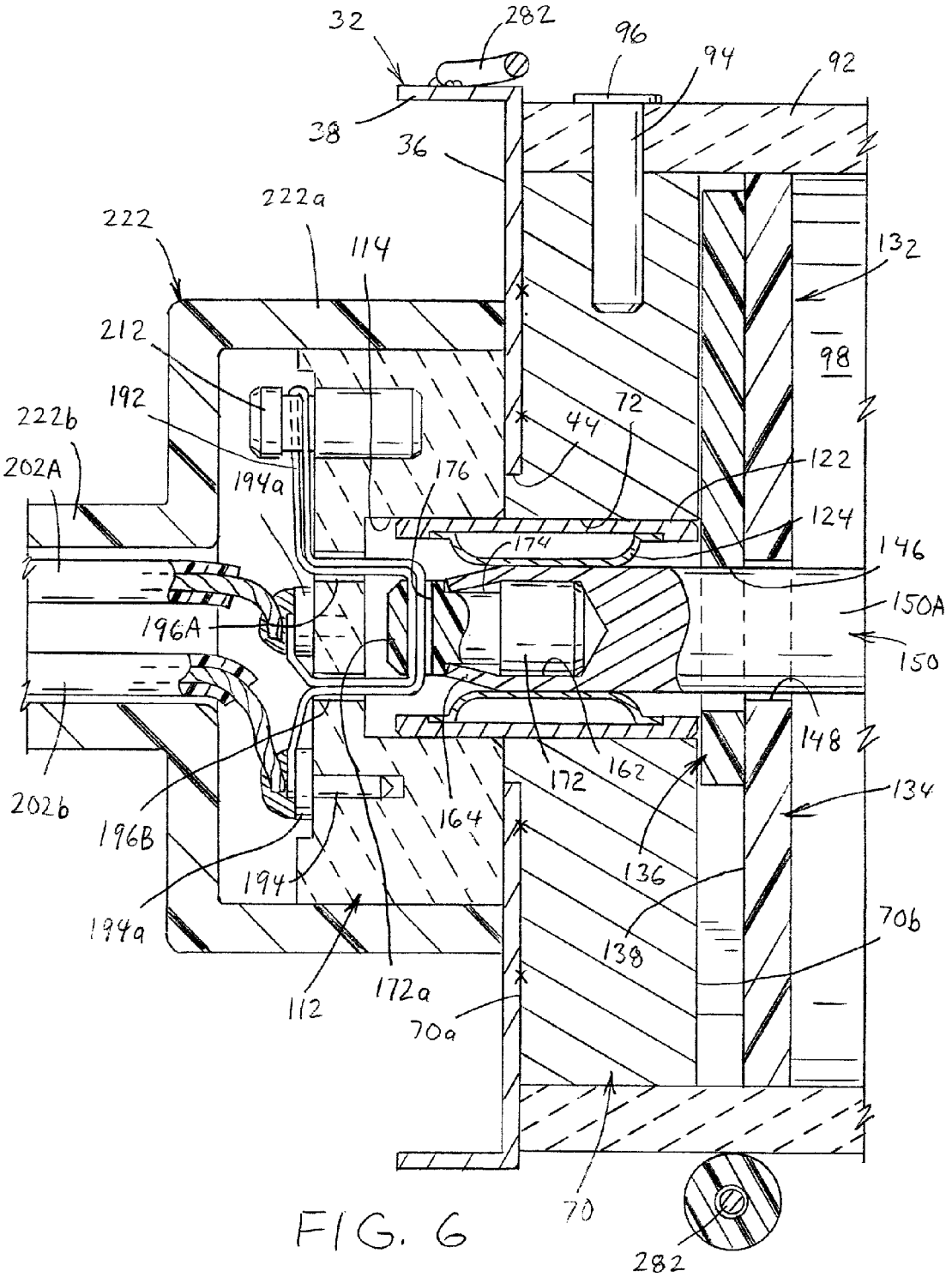
FIG. 6 is an enlarged view of a portion of the disconnect section showing a first end of a movable contact being restrained in electrical contact with a first stationary contact by a restraining element.
Figure 7:
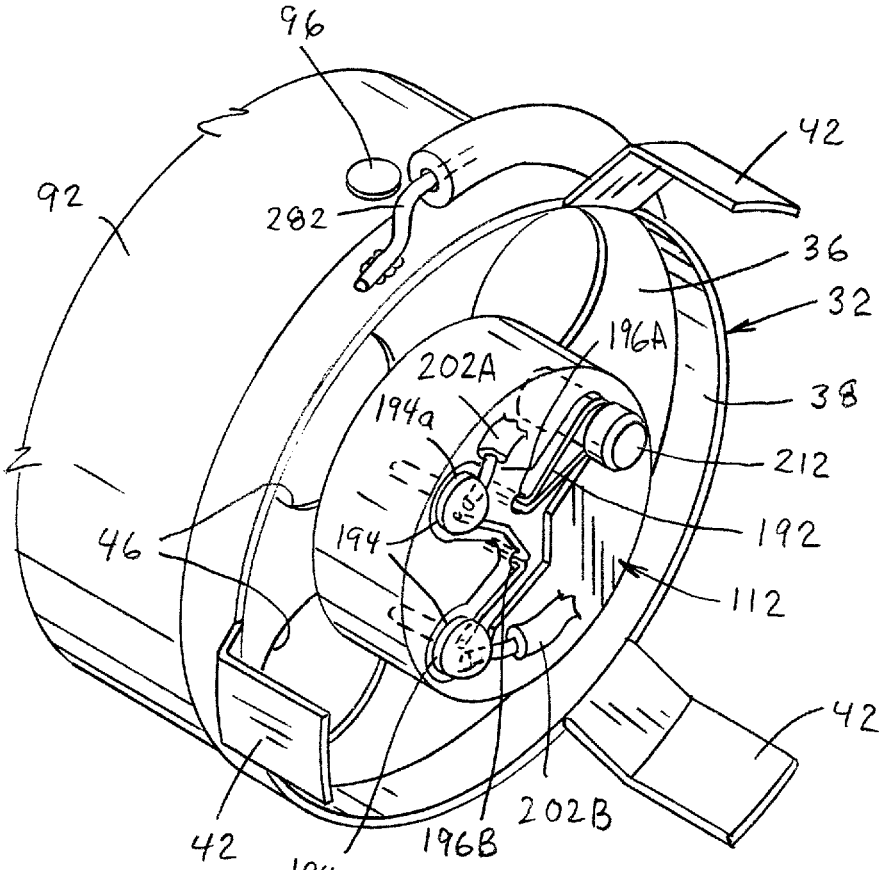
FIG. 7 is a perspective view of a first end of the fuse showing an insulating block and the restraining element connected thereto.

Referring now to FIGS. 4-6, movable contact 150 is best seen. Movable contact 150 is an elongated element dimensioned to have a length about twice the length of tubular insulator 92. In this respect, movable contact 150 is dimensioned to electrically connect first stationary contact 70 with second stationary contact 80. Movable contact 150 has an extending portion 152 that extends beyond second stationary contact 80 when a first end of movable contact 150 is within insert 122 in first stationary contact 70. In the embodiment shown, movable contact 150 is cylindrical in shape and dimensioned to have an outer diameter wherein movable contact 150 is electrically connected to resilient fingers or tangs 124 of insert 122 in first stationery contact 70 when the first end of the movable contact is within insert 122. Movable contact 150 is further dimensioned to be in electrical contact with insert 122 in second stationary contact 80.

In the embodiment shown, movable contact 150 is formed of a first section and a second section. The first section is preferably formed of a conductive material, such as, copper or brass or an alloy thereof. In the embodiment shown, the second section is comprised of an elongated shoulder screw having a threaded portion. The portion of the elongated shoulder screw is received within a threaded bore in the end of the contact section of movable contact 150.

Both first section 150A and second section 150B have the same outer diameter. Movable contact 150 has a uniform outer diameter over the major length thereof. The free end of first section 150A of movable contact 150 includes an axially aligned bore 162 dimensioned to receive a set pin 172. Bore 162 in the end of first section 150A of movable contact 150 defines a cylindrical, outer wall 164. Set pin 172 includes an annular groove 174, best seen in FIG. 6. Cylindrical set pin 172 is dimensioned such that a portion 172*a* extends thereof from the end of first section 150A of movable contact 150. Cylindrical outer wall 164 is preferably crimped or rolled such that the end of wall 164 is received within annular groove 174 of set pin 172, as shown in FIG. 6. Set pin 172 is preferably formed of a non-conductive material, such as, an epoxy glass. A hole 176 extends through set pin 172. Hole 176 is transverse to the axis of set pin 172.

The free end of section 150B of movable contact 150 defines an enlarged portion defining an annular surface. It is contemplated that movable contact 150 could also be formed of a single, elongated cylindrical rod of copper or a copper alloy and have a washer (not shown) maintained by an e-ring or cotter pin at one end thereof.

A biasing element 182 is operable to bias movable contact 150 in a first direction. In the embodiment shown, biasing element 182 is a helical spring that surrounds extending portion 152 of movable contact 150 and exerts an axial biasing force thereon. One end of the helical spring abuts insert 122 in second stationary contact 80, and another end of the helical spring abuts the annular surface defined by head 156 of the shoulder screw that forms second section 150B of movable contact 150.

As best seen in FIG. 9, in a first position, the shutter is positioned relative to the frame such that the openings in the shutter and frame align and movable contact 150 extends therethrough with the free end of movable contact 150 inserted within the insert in first stationary contact 70.

Referring now to FIG. 10, the moving contact is best seen. Movable contact 150 is an elongated member that extends through the cavity defined by the first and second stationary contacts and the tubular insulator. Movable contact 150 has a first end dimensioned to be received within the opening defined by the inserts in the first and second stationary contacts. In the embodiment shown, movable contact 150 is a cylindrical pin.

Movable contact 150 is maintained in the first position (best seen in FIG. 6) by a retaining element 192. In the embodiment shown, retaining element 192 is a wire that extends through transverse hole 176 in set pin 172 in movable contact 150. The ends of retaining element 192, i.e., the ends of the wire, connect to metallic nails or pins 194 embedded in insulating block 112, as best seen in FIG. 7. Pins or nails 194 have enlarged circular heads 194*a* that act as mounting pads wherein two leads 202A, 202B can be electrically connected to the ends of retaining element 192, by soldering using a high-temperature solder. Leads 202A, 202B are connected to a trigger actuating circuit 300, schematically illustrated in FIG. 11 that shall be described in greater detail below.

In the embodiment shown, retaining element 192 is a length of metal wire that extends through hole 176 in set pin 172 in the end of movable contact 150. One end of the wire is positioned to be connected to one of nails 194 embedded in insulating block 112, and the other end of the wire is positioned to be connected to the other nail 194 in insulating block 112. More specifically, in the embodiment shown, retaining element 192 is an elongated length of metal wire that is bent at its mid-section to form two side-by-side lengthwise sections of wire having a loop at one end. The looped end of the wire is attached to insulating set pin 212 that is fastened to insulating block 112. The two side-by-side sections of the wire extend from set pin 212 through an opening 196A in insulating block 112, through hole 176 in set pin 172 in moving contact 150 and then through an opening 196B in insulating block 112, as best seen in FIG. 6. The ends of retaining element 192 are connected respectively to leads 202A, 202B that connect to a trigger actuation circuit 300. In this respect, one end of retaining element 192 is attached to lead 202A and the other end of retaining element 192 is attached to lead 202B. Specifically, one end of lead 202A and one end of the retaining element 192 are soldered together onto the head of one of nails 194 that is embedded in insulating block 112. The other end of retaining element 192 is attached to one end of second lead 202B at the head of another nail 194 by soldering.

Figure 8:
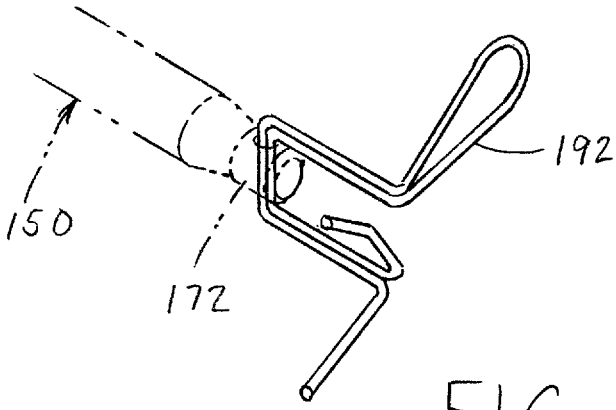
FIG. 8 is a perspective view showing the restraining element attached to the end of movable contact that is shown in phantom.

It is contemplated that a single wire extending through set pin 172 in movable contact 150 may be used to retain moving contact 150. By providing two smaller wires dimensioned in relation to biasing force exerted on moving contact 150, better performance can be obtained, as shall be described below. FIG. 8 illustrates the configuration of retaining element 192, i.e., the wire, in the embodiment shown. A tubular cover 222 covers insulating block 112 and the aforementioned connections. Cover 222 includes a large diameter portion 222*a* to cover insulating block 112 and a small diameter portion 222*b* that extends through opening 26 in first ferrule 22. A seal or gasket 223, best seen in FIGS. 4 and 5, is disposed between opening 26 in first end ferrule 22 and small diameter portion 222*b* of cover 222 to form a seal therebetween.

Figure 2:
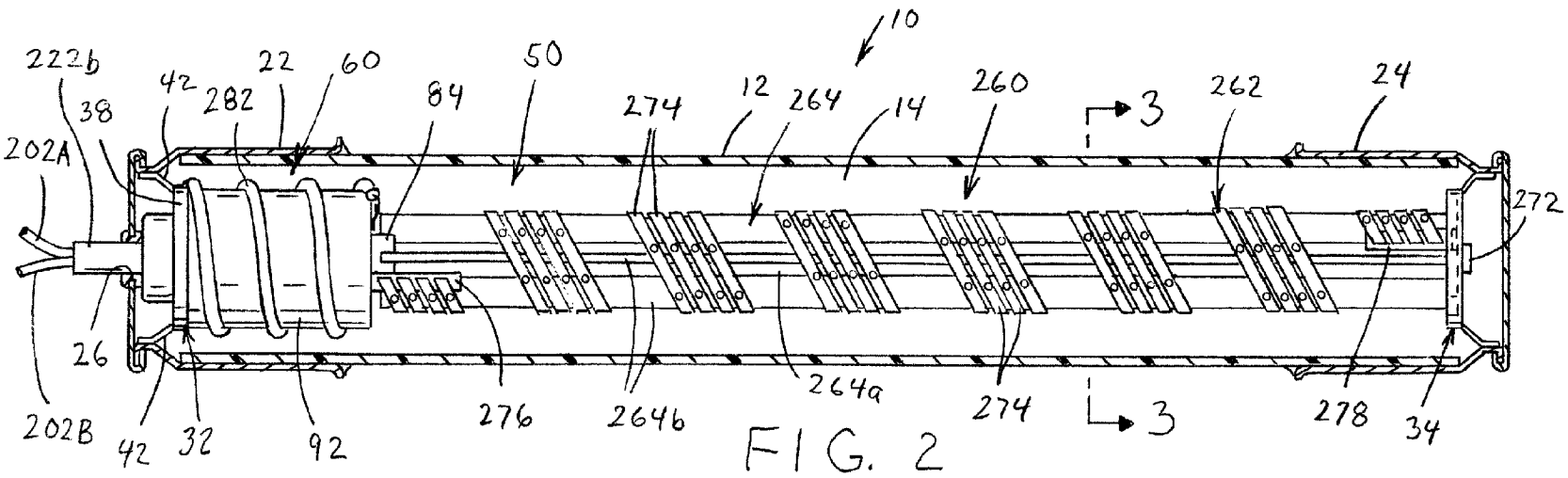
FIG. 2 is a cross-sectional view of the MV fuse taken along lines 2-2 of FIG. 1.
Figure 3:
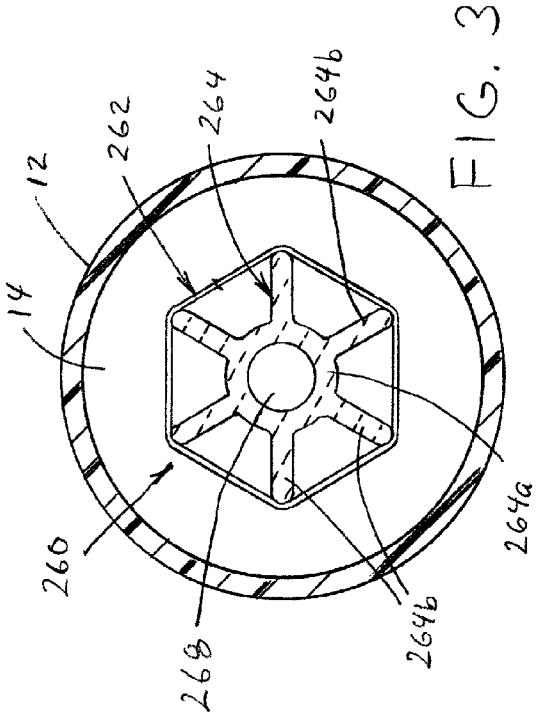
FIG. 3 is an enlarged cross-sectional view taken along lines 3-3 of FIG. 2.

Referring now to FIGS. 2 and 3, high-current fuse section 260 is best seen. Fuse section 260 is comprised of a first fusible element 262 that is mounted on an elongated support 264 that extends from disconnect section 60 to connector 34. Support 264, conventionally referred to as a "core" or a "spider," is comprised of an elongated tubular body 264*a* and a plurality of like vanes or rails 264*b* that extend lengthwise along the outer surface of tubular body 264*a*. Vanes or rails 264*b* extend radially outward from an axis through tubular body 264*a*. In this respect, support 264 is generally symmetrical about a central axis that extends the length of support 264. Tubular body 264*a* defines an elongated opening or passageway 268 that extends along the axis of support 264. Passageway 268 is dimensioned to receive extending portion 152 of movable contact 150 therein, as best illustrated in FIGS. 4 and 5. As shown in the drawings, vanes or rails 264*b* on support 264 are dimensioned and disposed on tubular body 264*a* to be matingly received in the slots in annular wall 84 on second stationary contact 80. When mounted on second stationary contact 80, opening or passageway 268 through support 264 is aligned with the axis of movable contact 150 and is isolated from cavity 14 defined by fuse casing 12. An end cap 272 covers and closes the opposite end of support 264 to totally enclose passageway 268. Support 264 is preferably formed of a non-conductive material, such as GMG (glass-melamine-glass), epoxy, or ceramic.

First fusible element 262 is comprised of one or more flat conducting members 274. Conducting members 274 preferably take the form of flat ribbons (rather than wires) to increase the surface dimensions. Conducting members 274 are wound around support 264 in a helical arrangement to increase the length of conducting members 274. Conducting members 274 of the illustrated embodiment include perforations (and/or notches) formed therein that reduce the cross-section of each member 274 and establish the current carrying capacity thereof. Conducting members 274 are preferably formed of silver, copper or copper alloys. The number and size of conducting members 274 determine the ampere rating of fuse 10. The present invention finds particular application for fuses rated from 0 to 100 Amps, but could also be used in fuses rated up to 600 Amps.

One end of first fusible element 262 is electrically connected to a conductive strap 276 that in turn is welded or soldered onto second stationary contact 80. The other end of first fusible element 262 is electrically connected to a conductive strap 278 that is welded or soldered onto connector 34 that in turn is electrically connected to second end ferrule 24.

A second fusible element 282, best seen in FIGS. 2, 4 and 5, is wound around insulator 92 of disconnect section 60. Second fusible element 282 is a wire having one end connected to side wall 38 of connector 32 attached to first end ferrule 22, as shown in FIG. 7. The other end of second fusible element 282 is electrically connected to second stationary contact 80, as shown in FIGS. 4 and 5. Second fusible element 282 is preferably a wire, comprised of silver, copper or copper alloy. Second fusible element 282 has a current carrying capacity significantly less than the current carrying capacity of first fusible element 267.

An arc quenching material (not shown) is disposed within cavity 14 of fuse casing 12 and surrounds disconnect section 60 and fuse section 260. In a preferred embodiment, the arc quenching material is comprised of silica quartz sand. As illustrated in the drawings, the configuration of disconnect section 60 is such that the arc quenching material is prevented from penetrating into chamber 98 defined by insulator 92. Still further, the arc quenching material does not enter into passageway 268 defined by tubular body 264*a* of support 264.

An electric fuse 10, as described above, defines two conductive paths. A first conductive path between first end ferrule 22 and second end ferrule 24 is comprised of disconnect section 60 in series with first fusible element 262. In this respect, first end ferrule 22 is in electrical contact with connector 32, which in turn, is in electrical contact with first stationary contact 70. Through movable contact 150, first stationary contact 70 is in electrical contact with second stationary contact 80 that, in turn, is connected to first fusible element 262. First fusible element 262 in turn is electrically connected to connector 34 that is electrically connected to second end ferrule 24.

A second conductive path defined between first end ferrule 22 and second end ferrule 24 is comprised of second fusible element 282 in series with first fusible element 262. In this respect, one end of second fusible element 282 is electrically connected to connector 32 and first end ferrule 22. The other end of second fusible element 282 is connected to one end of first fusible element 262. The other end of first fusible element 262 is connected to connector 34 that is connected to second end ferrule 24. In the foregoing configuration, second fusible element 282 is basically arranged in parallel to disconnect section 60.

Figure 11:
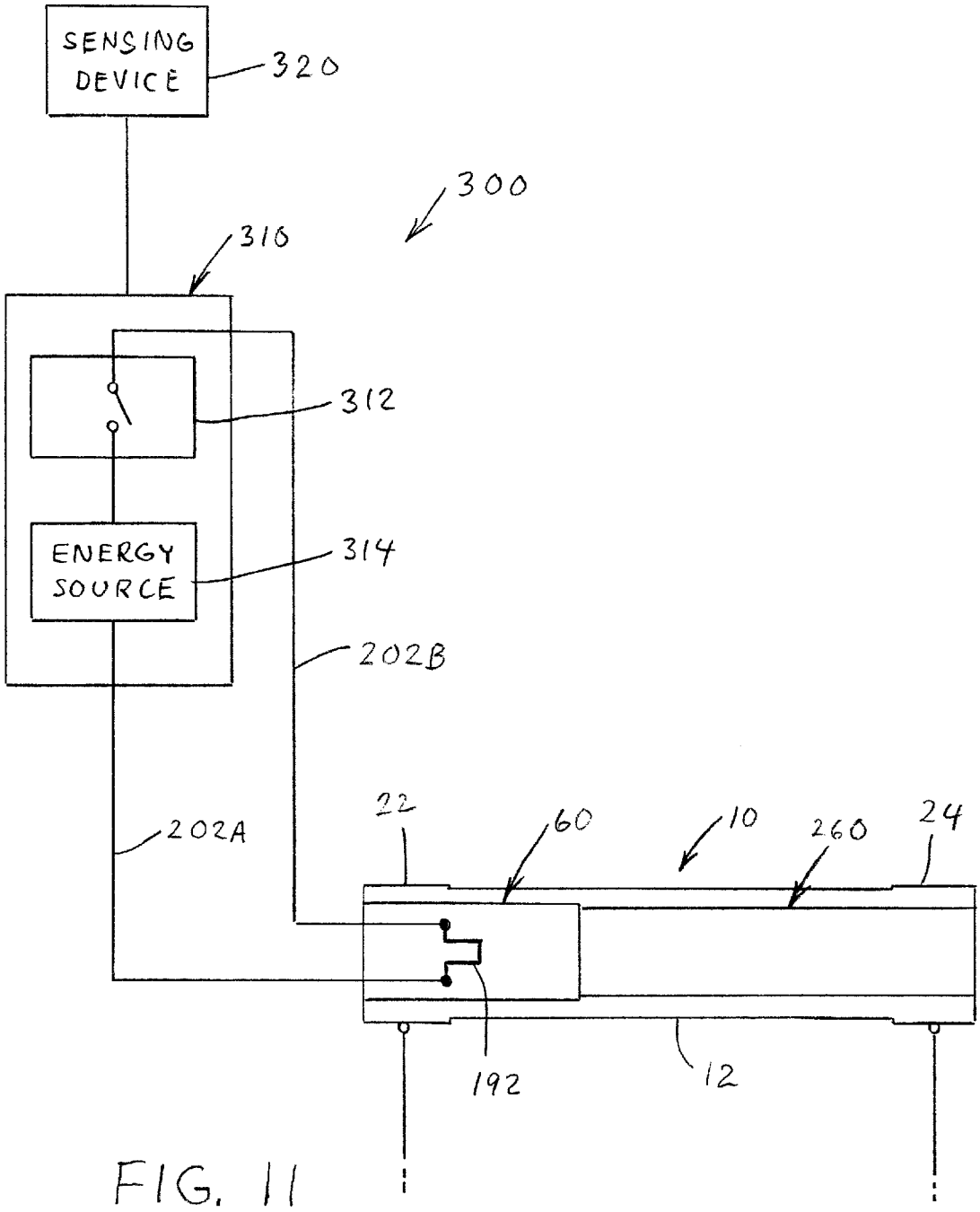
FIG. 11 is a schematic view of a trigger circuit for activating the disconnect section of the fuse.

It is contemplated that fuse 10 will be used as part of a fuse system 300, schematically illustrated in FIG. 11. Fuse system 300 is comprised of fuse 10, a fuse controller 310 and a sensing device 320. In the illustrated embodiment shown in FIG. 11, controller 310 includes a switch 312 and an energy source 314 (such as a charged capacitor or isolated power supply) that is capable of providing a pulse of energy and a power supply (not shown), such as a rechargeable battery.

Sensing device 320 is operable to detect an external condition or event, such as an arc flash, an overvoltage condition, a temperature level, a pressure level, etc. In response to detection of the external condition, controller 310 is programmed to command fuse 10 to open by supplying a "trigger signal" (i.e., a pulse of electrical energy) to retaining element 192 via leads 202A, 202B. In this respect, controller 310 causes energy source to apply sufficient electrical energy to retaining element 192 to heat the same to a temperature at which retaining element 192 melts. While fuse controller 310 in FIG. 11 has been shown connected to a single fuse, it is also contemplated that fuse controller 310 may also be connected to a plurality of fuses 10.

In the illustrated embodiment, controller 310 responds to sensing device 320 (e.g., a light sensor or dedicated arc flash detection equipment) detecting an external condition or event (e.g., an arc flash) by closing switch 312, and thereby applying a rapid pulse of electrical energy from energy source 314 (e.g., 1000 uF capacitor charged to 50V) to retaining element 192.

Referring now to the operation of fuse 10, under a conventional short circuit condition, when current in excess of approximately 20 times the nominal rated current of the fuse 10 passes through fuse 10 longer than 3-4 milliseconds, first fusible element 262 ionizes and forms and interrupts arc. (At higher currents, first fusible element 262 ionizes even sooner.) The interrupt arc is quenched within fuse casing 12 by the arc-quenching material. As a result, current flowing through first fusible element 262, and in turn fuse 10, is thus terminated.

Fuse 10 may also be operated by a signal from fuse system 300 that is connected by leads 202A, 202B to disconnect section 60. The normal operating configuration of disconnect section 60 is illustrated in FIG. 4. As shown in FIG. 4, movable contact 150 is in electrical contact with first stationary contact 70 and second stationary contact 80. Based upon an event sensed by sensing device 320, controller 310 causes energy source 314 to provide sufficient current energy to leads 202A, 202B and, in turn, to retaining element 192. The energy provided to retaining element 192 is at a level sufficient to melt retaining element 192. When retaining element 192 melts, movable contact 150 is then free to move away from first stationary contact 70 under the biasing force of biasing element 182. Movable contact 150 moves out of electrical contact with insert 122 in first stationary contact 70, and passes through openings 146, 148 in shutter assembly 132. In other words, movable contact moves from its first position shown in FIG. 4 to a second position illustrated in FIG. 5 wherein biasing element 182 causes movable contact 150 to move through passageway 268 of support 264, as illustrated by the arrow in FIG. 5. Since movable contact 150 no longer restrains shutter 136, shutter 136 moves from its first position, illustrated in FIG. 9 to a second position, illustrated in FIG. 10, where openings 146, 148 are no longer aligned and shutter 136 isolates the end of movable contact 150 from first stationary contact 70, thus separating the respective contacts 70, 150 from each other and preventing any arcing therebetween. As a result, the first current path through movable contact 150 and first stationary contact 70 is broken, and current flows through the second current path, i.e., namely through second fusible element 282. Because the current-carrying capacity of second fusible element 282 is less than that of first fusible element 262, second fusible element 282 is only capable of conducting current at the fuse's rated current for a very short duration of time before second fusible element 282 vaporizes. In this respect, second fusible element 282 is dimensioned to allow sufficient separation of the end of movable contact 150 from first stationary contact 70 and closing of shutter assembly 136, so as to prevent arcing as movable contact 150 moves away from first stationary contact 70. In other words, second fusible element 282 essentially acts as a shunt to prevent arcing when disconnect section 60 is operable to break the circuit through fuse 10.

The present invention thus provides a medium-voltage fuse 10 that provides standard, conventional over-current protection to a fuse circuit but, at the same time, is responsive to commands from an external sensing circuit 300 to open fuse 10 when an event outside fuse 10 occurs.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. An electric fuse, comprised of:

a tubular casing formed of an electric insulating material;

a first conductive ferrule attached to a first end of said casing, said first conductive ferrule having an opening therethrough;

a second conductive ferrule attached to a second end of said casing;

a first fusible element within said casing, said first fusible element having one end electrically connected to said second conductive ferrule; and a disconnect section electrically connected in series to a second end of said first fusible element and to said first conductive ferrule, said disconnect section comprised of:

a first stationary contact electrically connected to said first conductive ferrule;

a second stationary contact electrically connected to said first fusible element;

a tubular insulator disposed between said first and second stationary contacts, wherein said stationary contacts are attached to the ends of said tubular insulator to define an enclosed chamber;

an elongated tubular support extending from said disconnect section, said support defining an elongated passageway that is in communication with said enclosed chamber in said disconnect section, a movable contact movable within said enclosed chamber and said passageway in said tubular support from a first position electrically connecting said first and second stationary contacts to form a conductive path through said disconnect section to a second position electrically separating said first and second stationary contacts from each other and terminating said conductive path through said disconnect section, said movable contact being biased toward said second position;

a retaining element holding said movable contact in said first position, said retaining element being electrically isolated from said first and second conductive ferrules and releasing said movable contact from said first position when activated by an electrical (actuation) signal from an external source; and a second fusible element electrically connected between said first conductive ferrule and said second end of said first fusible element to be in series with said first fusible element and connected in parallel to said disconnect section.

2. An electric fuse as defined in claim 1, wherein said movable contact is an elongated pin having a first end in electrical contact with said first stationary contact when said movable contact is in said first position.

3. An electric fuse as defined in claim 1, wherein said second fusible element is an elongated wire wrapped in helical fashion about the outer surface of said tubular insulator.

4. An electric fuse as defined in claim 1, wherein said movable contact extends through an opening in said second stationary contact.

5. An electric fuse as defined in claim 4, wherein an extending portion of said movable contact extends through said second stationary contact.

6. An electric fuse as defined in claim 5, further comprising a helical spring surrounding said extending portion of said movable contact, said spring biasing said movable contact toward said second position.

7. An electric fuse as defined in claim 4, wherein said fuse casing is symmetrical about an axis, and said movable contact is aligned and movable along said axis.

8. An electric fuse as defined in claim 1, further comprising leads connecting said retaining element to an external trigger circuit, said trigger circuit providing a signal to said retaining element to release said movable contact upon the occurrence of an external event.

9. An electric fuse as defined in claim 1, further comprising:

a movable shutter disposed within said tubular insulator for isolating said movable contact from said first stationary contact as said movable contact moves from said first position to said second position.

10. An electric fuse as defined in claim 9, wherein said shutter is movable along a frame, said shutter movable between a first position, wherein said movable contact can form a conductive path between said first and second stationary contacts, and a second position, wherein said shutter forms a barrier between said first and second stationary contacts.

11. An electric fuse as defined in claim 10, wherein said shutter has an opening therethrough and frame has an opening therethrough, said openings in said shutter and frame being dimensioned to allow said movable contact to pass therethrough and being in registry with each other and when said shutter is in said first position.

12. An electric fuse as defined in claim 11, wherein said shutter is biased to said second position.

13. An electric fuse as defined in claim 1, wherein said first fusible element is mounted on said tubular support.

14. An electric fuse as defined in claim 1, wherein said tubular support is formed of a non-conductive material and includes a plurality of spaced-apart vanes that extend along the length of said tubular support and project radially outwardly therefrom, said first fusible element being helically wrapped around said tubular support between said disconnect section and said second conductive ferrule.

15. An electric fuse as defined in claim 1, wherein said fuse is filled with an arc-quenching material that surrounds said disconnect section and said support but is isolated from said chamber and said passageway.

* * * * *